United States Patent [19]

Fachbach et al.

[11] 4,203,409

[45] May 20, 1980

[54] LOW-NOISE-LEVEL INTERNAL COMBUSTION ENGINE

[75] Inventors: Heinz Fachbach; Gerhard Thien; Peter C. Meurer, all of Graz, Austria

[73] Assignee: Hans List, Graz, Austria

[21] Appl. No.: 961,411

[22] Filed: Nov. 16, 1978

[30] Foreign Application Priority Data

Nov. 23, 1977 [AT] Austria ..... 8415/77

[51] Int. Cl.[2] ..... F02B 77/00

[52] U.S. Cl. ..... 123/198 E; 123/195 A; 123/195 C; 181/204

[58] Field of Search ..... 123/198 E, 195 C, 195 S, 123/195 A; 181/204

[56] References Cited

U.S. PATENT DOCUMENTS

| | | | |
|---|---|---|---|
| 3,464,398 | 9/1969 | Scheiterlein et al. | 123/198 E |
| 3,540,425 | 11/1970 | Scheiterlein et al. | 181/204 |
| 3,693,602 | 9/1972 | Thien et al. | 123/195 C |
| 3,695,386 | 10/1972 | Thien et al. | 123/195 C |
| 3,991,735 | 11/1976 | Horstmann | 123/195 C |
| 4,071,008 | 1/1978 | Skatsche | 123/198 E |
| 4,077,383 | 3/1978 | Hatz | 123/198 E |
| 4,137,888 | 2/1979 | Allan | 123/198 E |

FOREIGN PATENT DOCUMENTS

| | | | |
|---|---|---|---|
| 2245126 | 4/1973 | Fed. Rep. of Germany | 123/198 E |
| 2315012 | 2/1977 | France | 123/198 E |
| 2390794 | 1/1979 | France | 123/198 E |

*Primary Examiner*—Ira S. Lazarus

*Attorney, Agent, or Firm*—Watson, Cole, Grindle & Watson

[57] ABSTRACT

A low-noise-level combustion engine comprises an engine unit support with auxiliary units rigidly connected thereto, a crankcase and a flywheel case. The engine unit support, as an engine part directly affected by sound vibration, is connected to the crankcase by at least three resonance-absorbing elements which provide power transmission from the engine unit support to the crankcase. The engine comprises further a sealing element located between the engine unit support and the crankcase, which divides the engine into a lower oil-wetted engine region and an upper dry engine region which is oil-tightly sealed against the lower engine region. The sealing element surrounds the engine, the engine unit support, and is attached to the engine unit support and to the crankcase. It has no supporting function and is highly resilient.

8 Claims, 7 Drawing Figures

LOW-NOISE-LEVEL INTERNAL COMBUSTION ENGINE

BACKGROUND OF THE INVENTION

This invention relates to a low-noise-level internal combustion engine comprising a crankshaft and crankshaft main bearings (which are engine parts directly affected by body resonance and sound vibration), an engine unit support which supports the crankshaft main bearings, a cylinderhead mounted on the engine unit support, auxiliary units rigidly connected to the engine unit support and to the cylinderhead, and further comprising a crankcase and a flywheel case connected with the crankcase. The engine parts which are directly affected by sound vibration are connected to the crankcase and the flywheel case in a resonance-absorbing manner and the engine comprises further a sealing element located between the engine parts which are directly affected by sound vibration and the acoustically insulated engine parts. The sealing element divides the engine into a lower oil-wetted engine region and an upper dry engine region which is sealed in oil-tight fashion against the lower engine region by means of the sealing element.

DESCRIPTION OF THE PRIOR ART

With the afore-described construction, disclosed in the U.S. Pat. No. 4,071,008, a very satisfactory reduction of noise emission was obtained. In this known embodiment, connection between the engine unit support and the crankcase was made by a frame-like resonance-absorbing element which had to function simultaneously as a power transmitting member and as a sealing member against the oil-wetted region of the crankcase. Therefore a special and relatively complicated element was necessary which had to enable a compromise between good body resonance-absorbing ability and power transmission on the one hand, and durability on the other hand, due to its double function. Because of the contact of the resonance-absorbing element at least with engine oil mist, restrictions also arose with regard to the selection of the material for the resonance-absorbing element. Besides this, the machining of the seating surfaces of the resonance-absorbing element at the engine unit support and the crankcase, and also the assembling procedure, made the known construction more complicated and expensive.

SUMMARY OF THE INVENTION

It is the aim of this invention to provide an engine of the kind referred to at the beginning wherein a more advantageous connection between the engine unit support and the crankcase is achieved, thereby avoiding the afore-described disadvantages.

The present invention consists in that the resonance-absorbing connection between the engine unit support and the crankcase is made by at least three resonance-absorbing elements located entirely outside the oil-wetted region and secured to the crankcase. A sealing element surrounding the engine unit support is attached to the engine unit support and to the crankcase having no supporting function and being highly resilient. Besides achieving significantly lower production costs, the main advantage of the construction according to the invention is that the engine unit support is supported by simple, possibly readily available in trade (however, in any case very precise-shaped producible) resonance-absorbing elements. Thus, exact positioning of the engine unit support and the crankshaft, respectively, with regard to the crankcase, or the flywheel case is ensured in a simple way. The use of single supporting resonance-absorbing elements instead of a continuous frame-like element has the further advantage that a relatively hard type of rubber for the elements may be used without having to put up with a less effective noise reduction due to the local introduction of body resonance and sound vibration. On the other hand, the use of hard rubber elements diminishes the relative movements of the engine unit support against the crankcase in operation. Another advantage is that the resonance-absorbing elements are never in contact with the hot engine lubricant because they are located in the upper, cooler and not oil-wetted region of the engine, so that the durability of the elements is improved.

The sealing element sealing the oil-wetted lower engine region is extraodinarily resilient and has no supporting forces at all acting on it. Therefore it has a sufficient durability despite its contact with the engine oil. Due to the very soft material, transmission of body resonance is also safely avoided.

According to another embodiment of the invention, for engine torque transmission two of the resonance-absorbing elements supporting the engine unit support are arranged at the crankcase laterally offset from the plane of symmetry of the engine and substantially in a plane with the elastic supporting elements in the region of the flywheel housing which carry the engine and absorb the engine torque reaction, for instance in a vehicle, and a third resonance-absorbing element is arranged in the plane of symmetry of the engine on the crankcase at the end of the engine opposite the flywheel. This kind of support for the engine unit support enables, in combination with the known three-point-suspension of the engine in a vehicle, the transmission of the engine forces on the shortest way over the crankcase and the flywheel case to the engine suspension. This results in advantageously low stress and deformations of the crankcase so that it may be constructed in a thinner and lighter and therefore more cost-saving manner.

According to a further embodiment, four resonance-absorbing elements are used which are arranged two by two and opposite each other in a plane. The elements supporting the engine unit support at its front and at its rear end are located in the plane of symmetry of the engine and the lateral elements for engine torque transmission are located substantially in the longitudinal median plane of the engine. With this construction the afore-described advantage of short transmission of the engine forces is also maintained when the engine suspension points may not be arranged in the region of the flywheel case but approximately at the longitudinal median plane of the engine.

It may be further advantageous when the engine unit support is provided with supporting arms which engage the resonance-absorbing elements. This ensures a large latitude with respect to the construction of the engine unit support connection without acoustic drawbacks. As a special advantage the possibility of using resonance-absorbing elements usual in trade is obtained because the supporting arms, especially when they are bolted to the engine unit support, can be easily adapted to fit the commercial elements.

According to a further embodiment of the invention, the engine unit support is provided in the region of its lower end on both sides with at least one lateral supporting device comprising a supporting arm, an elastic member, and an adjusting device which is connected to the crankcase and externally adjustable. This enables, in the sense of optimal body resonance reduction, to use soft resonance-absorbing elements because the lateral supporting device prevents the engine unit support from making undue relative movements against the crankcase. The adjusting device serves not only for adjusting the position of the engine unit support but also gives the possibility of applying proper initial stress to the elastic elements of the lateral supporting device.

A further reduction of production and assembling costs can be obtained when the supporting arms of the lateral supporting device are made integral with the respective main bearing cap.

DESCRIPTION OF THE DRAWINGS

The invention will be hereinafter more specifically explained with reference to two exemplary embodiments depicted in the accompanying drawings wherein.

DETAILED DESCRIPTION OF THE PREFERRED EMBODIMENTS

Figure 1:
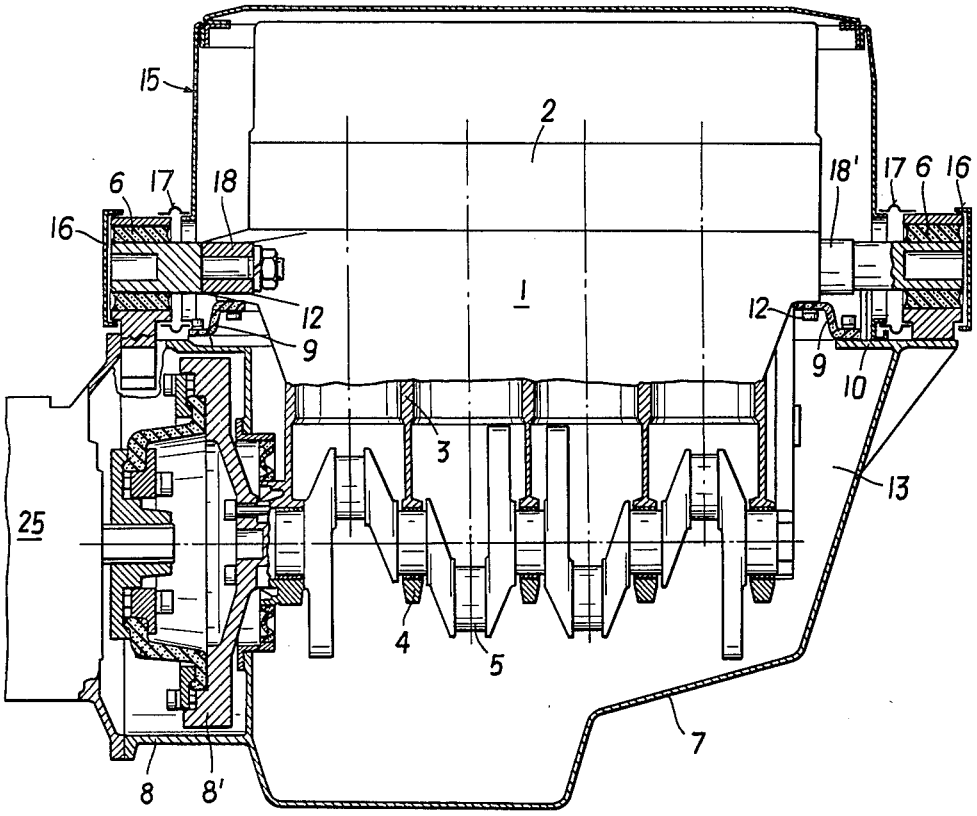
FIG. 1 is a partial longitudinal section of an engine according to the invention.

The internal combustion engine according to the invention comprises an engine unit support 1 which contains the power-leading engine structure, namely cylinderhead 2, cylinder 3, crankshaft main bearings 4, and crankshaft 5. The engine unit support 1 is connected to a crankcase 7 by means of resonance-absorbing elements 6 which also serve for power transmission. The crankcase 7 is cast integral with a flywheel case 8. The engine unit support 1 is surrounded by an elastic sealing element 9 which is secured to the engine unit support 1 and to the crankcase 7 on flanges 10,11 by screws 12, thereby closing the aperture on the upper side of the crankcase 7. Attachment of the sealing element can also be made, for instance, by an adhesive or by inserting it into slots provided on the engine unit support 1 and the crankcase 7. The sealing element 9 has to overtake no forces at all and it serves only for sealing the oil-wetted space 13 of the crankcase 7.

In the depicted embodiment the cylinderhead 2, an injection pump 14 and other (not shown) auxiliaries are enclosed by a sound-reducing encapsulation 15 which is secured to the crankcase 7. Some auxiliaries, for instance a water-pump and a dynamo, may also be arranged at the crankcase 7. The resonance-absorbing elements 6 are integrated to the encapsulation 15 and on their outer sides they are provided with caps 16 to prevent there noise emission. For the same reason the unavoidable gaps between the encapsulation and the resonance-absorbing elements are covered by elastic sealing sleeves 17. The engine unit support 1 is provided with supporting arms 18 which engage the resonance-absorbing elements 6. The supporting arms 18 may be bolted to the engine unit support or cast integral with it.

Figure 2:
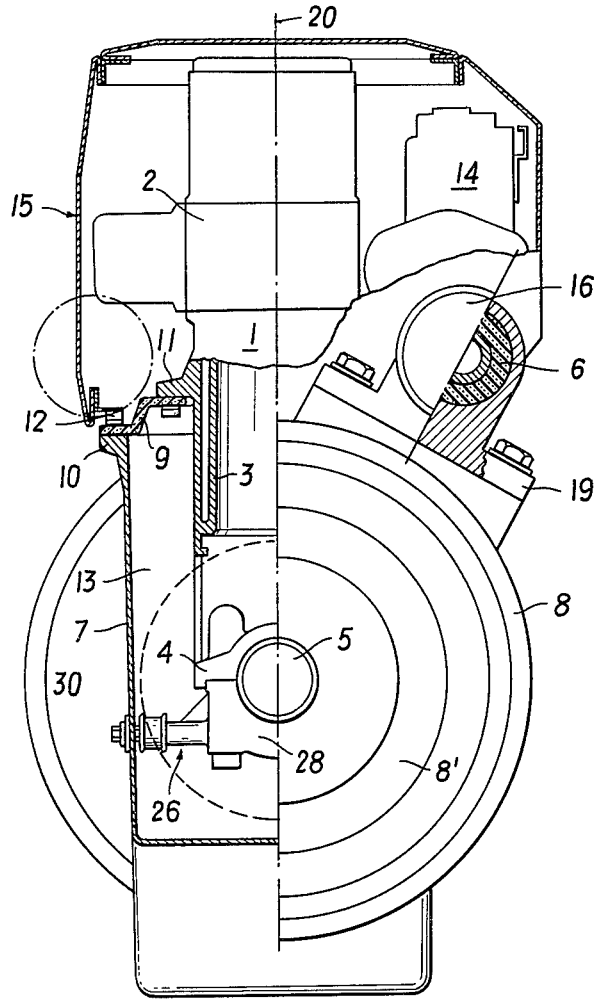
FIG. 2 is a plan view on arrow II of FIG. 1 with the gearbox removed, and partly in section.
Figure 3:
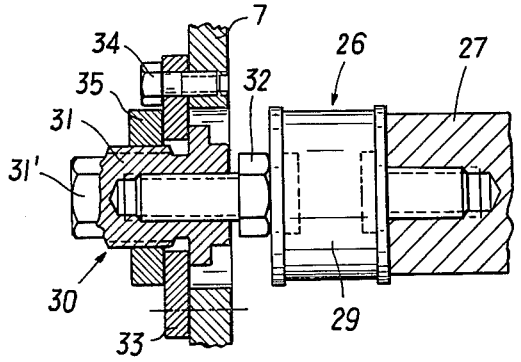
FIG. 3 is a detail of FIG. 2 on a larger scale.
Figure 4:
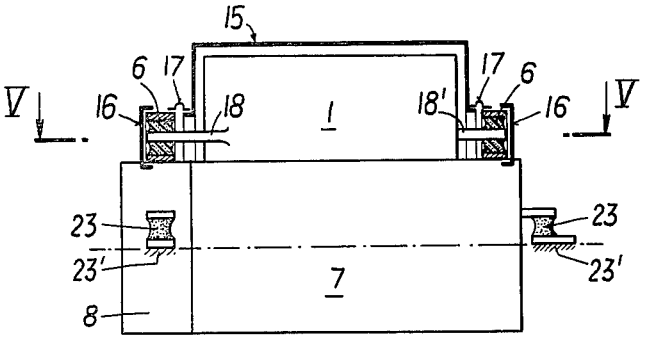
FIG. 4 is a longitudinal plan view of a schematically represented engine according to the invention, partly in section.
Figure 5:
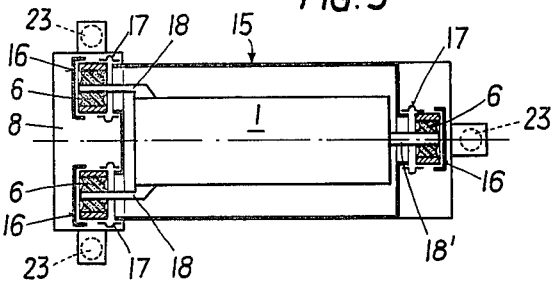
FIG. 5 is a section on line V—V of FIG. 4.

In FIGS. 2 and 3 a lateral supporting device 26 for the engine unit support 1 is represented which is located in the crankcase 7. The respective device on the other side is not shown. Due to the elastic connection of the engine unit support 1 to the crankcase 7, relative movements between these two engine parts are unavoidable. Especially when using soft resonance-absorbing elements, these movements may be relatively large, particularly when running the engine through the resonance speed. The lateral supporting device 26 prevents the engine unit support from making undue deflections. Such lateral supporting devices may be arranged on both sides in the longitudinal median plane or on both end of the engine unit support. The supporting arms 27 may be integral with the respective crankshaft main bearing caps 28. Between the supporting arm 27 and the crankcase 7 there is arranged an elastic member 29 secured to the supporting arm 27 on the one side and connected to an adjusting device 30 on the other side, which is secured to the crankcase 7. The adjusting device 30 comprises a threaded bolt 31 which engages a screw 32 fixed to the elastic member 29. The bolt 31 is secured to the crankcase by a holding plate 33 and screws 34. The bolt 31 is provided with a hexagon head 31′ which serves to turn the bolt 31 so that the position of the engine unit support may be externally adjusted. Besides this, initial tension can be applied to the elastic members 29. After having carried out the desired adjustment, the bolt 31 is locked by a lock nut 35.

FIGS. 4,5 and 6,7 show two embodiments of the connection between engine unit support 1 and crankcase 7, and the arrangement of the engine suspension points, for instance for mounting in a vehicle. The embodiment of FIGS. 4 and 5 corresponds to that of FIGS. 1 and 2. On the flywheel side the engine unit support 1 is provided with lateral supporting arms 18 each of which engage a resonance-absorbing element 6. The elements 6 are secured to the flywheel case 8 (FIG. 2) by bearing blocks 19. On the opposite end the engine unit support 1 is provided with a third supporting arm 18′ in the plane of symmetry which also engages a resonance-absorbing element 6. The described three supporting points form a supporting triangle. Torque transmission from the engine unit support 1 to the crankcase 7 is ensured by the two supporting points at the flywheel side.

For the engine suspension there are provided three suspension points 23′, two of them are located laterally on the flywheel case 8. These points have to absorb the engine torque and they are preferably arranged in the same plane in which the supporting points for the torque transmission of the engine unit support are located. This arrangement ensures a short power transmission from the engine unit support 1 over the crankcase 7 to the vehicle chassis, so that deformations of the crankcase are largely avoided. The third suspension point is located on the engine end opposite the flywheel in the plane of symmetry 20. The engine suspension is made in the usual manner by elastic elements 23.

Figure 6:
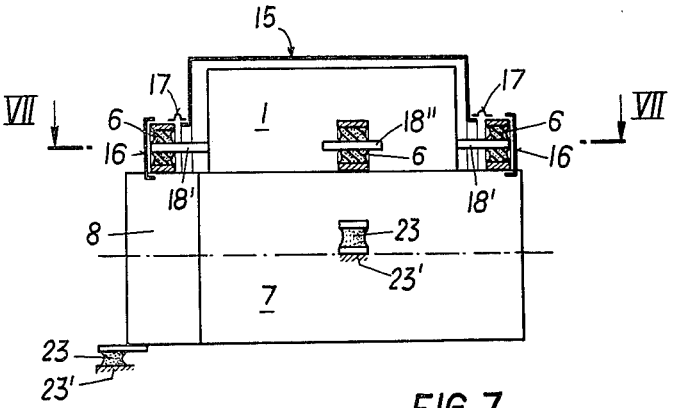
FIG. 6 is a longitudinal plan view according to FIG. 4 of another embodiment.
Figure 7:
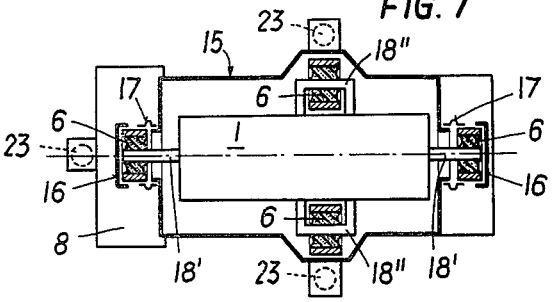
FIG. 7 is a section on line VII—VII of FIG. 6. The same parts have identical references.

In the embodiment of FIGS. 6 and 7 four resonance-absorbing elements 6 connect the engine unit support 1 to the crankcase 7. They are arranged two by two opposite each other in a plane. The two lateral elements 6 again serve for torque transmission, and they are located substantially in the longitudinal median plane of the engine and engaged by supporting arms 18''. To also ensure short power-transmission, the lateral engine suspension points with the elastic elements 23 are arranged in the longitudinal median plane of the engine. The third suspension point may be located at the gear-box flanged to the engine.

We claim:

1. A low-noise-level internal combustion engine comprising a crankshaft and crankshaft main bearings which are engine parts directly affected by body resonance and sound vibration, an engine unit support which supports said crankshaft main bearings, a cylinderhead mounted on said engine unit support, auxiliary units rigidly connected to the engine unit support and to the cylinderhead, and further comprising a crankcase and a flywheel case connected with the crankcase, said engine parts which are directly affected by sound vibration being connected to said crankcase and flywheel case in a resonance-absorbing manner, the engine comprising further a sealing element located between said engine parts which are directly affected by sound vibration and said acoustically insulated engine parts, said sealing element dividing the engine into a lower oil-wetted engine region and an upper dry engine region which is oil-tightly sealed against said lower engine region by means of said sealing element, the resonance-absorbing connection between the engine unit support and the crankcase being made by at least three resonance-absorbing elements located entirely outside said oil-wetted region and secured to the crankcase, said sealing element surrounding the engine unit support being attached to the engine unit support and to the crankcase having no supporting function and being highly resilient.

2. An internal combustion engine according to claim 1 wherein for engine torque transmission two of the resonance-absorbing elements supporting the engine unit support are arranged at the crankcase laterally offset from the plane of symmetry of the engine and substantially in a plane with the elastic supporting elements in the region of the flywheel housing carrying the engine and absorbing the engine torque reaction, for instance in a vehicle, and wherein a third resonance-absorbing element is arranged in the plane of symmetry of the engine on the crankcase at the end of the engine opposite the flywheel.

3. An internal combustion engine according to claim 1 wherein four resonance-absorbing elements are used arranged two by two opposite each other in a plane, the elements supporting the engine unit support at its front and at its rear end being located in the plane of symmetry of the engine and the lateral elements for engine torque transmission being located substantially in the longitudinal median plane of the engine.

4. An internal combustion engine according to claim 1 wherein the engine unit support is provided with supporting arms which engage the resonance-absorbing elements.

5. An internal combustion engine according to claim 1 wherein the engine unit support is provided in the region of its lower end on both sides with at least one lateral, supporting device comprising a supporting arm, an elastic member, and an adjusting device which is connected to the crankcase and externally adjustable.

6. An internal combustion engine according to claim 5 wherein the supporting arms of the lateral supporting device are made integral with the respective crankshaft main bearing caps.

7. An internal combustion engine according to claim 1 wherein the engine parts and auxiliaries located above the sealing element are enclosed by a sound-reducing encapsulation.

8. An internal combustion engine according to claim 7 wherein the resonance-absorbing elements are acoustically included in the encapsulation.

* * * * *